US006640385B2

(12) United States Patent
Oh et al.

(10) Patent No.: US 6,640,385 B2
(45) Date of Patent: Nov. 4, 2003

(54) CYCLONE DUST COLLECTING APPARATUS FOR A VACUUM CLEANER

(75) Inventors: Jang-keun Oh, Kwangju (KR); Jang-youn Ko, Kwangju (KR)

(73) Assignee: Samsung Kwangju Electronics Co., Ltd., Kwangju (KR)

( * ) Notice: Subject to any disclaimer, the term of this patent is extended or adjusted under 35 U.S.C. 154(b) by 0 days.

(21) Appl. No.: 10/037,170

(22) Filed: Oct. 22, 2001

(65) Prior Publication Data

US 2002/0088078 A1 Jul. 11, 2002

(30) Foreign Application Priority Data

Jan. 10, 2001 (KR) ..... 2001-1421

(51) Int. Cl.[7] ..... A47L 9/16

(52) U.S. Cl. ..... 15/352; 15/353; 55/429; 55/459.1; 55/DIG. 3

(58) Field of Search ..... 15/352, 353; 55/429, 55/459.1, DIG. 3

(56) References Cited

U.S. PATENT DOCUMENTS

| | | | | | |
|---|---|---|---|---|---|
| 2,071,975 | A | * | 2/1937 | Holm-Hansen et al. | 15/353 |
| 2,768,707 | A | * | 10/1956 | Campbell | 55/429 |
| 3,320,727 | A | * | 5/1967 | Farley et al. | 15/353 |
| 3,543,325 | A | * | 12/1970 | Hamrick | 55/429 |
| 4,172,710 | A | * | 10/1979 | van der Molen | 15/353 |
| 5,145,499 | A | | 9/1992 | Dyson | 55/337 |
| 5,287,591 | A | * | 2/1994 | Rench et al. | 15/352 |
| 6,003,196 | A | * | 12/1999 | Wright et al. | 15/353 |
| 6,146,434 | A | * | 11/2000 | Scalfani et al. | 15/353 |
| 6,398,834 | B2 | | 6/2002 | Oh | 55/424 |
| 6,406,505 | B1 | | 6/2002 | Oh et al. | 55/337 |
| 6,428,589 | B1 | * | 8/2002 | Bair et al. | 15/353 |

FOREIGN PATENT DOCUMENTS

| | | |
|---|---|---|
| DE | 19938774 | 3/2001 |
| DE | 10056935 | 2/2002 |
| EP | 0489565 | 12/1991 |
| EP | 0928594 | 7/1999 |
| GB | 2317122 | 9/1996 |
| GB | 2321181 | 2/1997 |
| GB | 2344278 | 6/2000 |
| GB | 2365324 | 2/2002 |
| JP | 2001157463 | 3/2001 |
| WO | WO9835603 | 8/1998 |
| WO | WO0049933 | 2/2000 |
| WO | WO0074548 | 3/2000 |
| WO | WO0114066 | 3/2000 |
| WO | WO0132066 | 11/2000 |
| WO | WO0145853 | 12/2000 |

* cited by examiner

*Primary Examiner*—Theresa T. Snider
(74) *Attorney, Agent, or Firm*—Ladas & Parry

(57) ABSTRACT

A cyclone dust collecting apparatus for a vacuum cleaner includes a cyclone body and a separately removable contaminant receptacle. The cyclone body, which is fixed to a fan motor portion of a cleaner body, separates contaminants from the air that is drawn into the cleaner body. The cyclone body having a contaminant outlet, through which the contaminants are discharged. The contaminant receptacle is removably coupled to a lower side of the cyclone body and receiving the contaminants through a contaminant inlet that is aligned with the contaminant outlet of the cyclone body. Since the contaminant receptacle is removable independent of the cyclone body, it is smaller, lighter and easier for a user to handle.

10 Claims, 4 Drawing Sheets

CYCLONE DUST COLLECTING APPARATUS FOR A VACUUM CLEANER

BACKGROUND OF THE INVENTION

1. Field of the Invention

The present invention relates to a cyclone dust collecting apparatus for a vacuum cleaner, and more particularly, to a cyclone dust collecting apparatus for a vacuum cleaner having a removable contaminant receptacle.

2. Description of the Related Art

Generally, a cyclone dust collecting apparatus replaces a disposable dust collecting bag for collecting contaminants, such as dust in a vacuum cleaner. The cyclone dust collecting apparatus uses centrifugal force to separate the contaminants from the air that is drawn into the cleaner body, and collects the separated contaminants.

FIG. 1 shows a vacuum cleaner having a conventional cyclone dust collecting apparatus.

Referring to FIG. 1, the conventional cyclone dust collecting apparatus of the vacuum cleaner includes a cyclone body 11 for separating contaminants from the air by centrifugal force, and a contaminant receptacle 13 integrally formed with a lower portion of the cyclone body 11. The contaminant receptacle 13 collects the contaminants that have been separated from the air. A base plate 15 is disposed on a lower end of the contaminant receptacle 13. One edge of the base plate 15 is connected to the lower end of the contaminant receptacle 13 by a hinge, while the other edge opposite to the hinged edge is supported by a base plate opening/closing means 16 formed on a side of the contaminant receptacle 13. Accordingly, when the base plate opening/closing means 16 is opened, the base plate 15 can pivot about the hinge, exposing the interior of the contaminant receptacle 13.

The operation of the vacuum cleaner having the conventional cyclone dust collecting apparatus 10 will be described below.

A fan motor portion 9 (FIG. 2) of the vacuum cleaner generates a suction force to draw in air and contaminants, such as dust, through a suction brush 5. The air and the contaminants are then directed through an extension pipe 2 and a hose 3 and into the cyclone dust collecting apparatus 10. As the air is drawn into the cyclone body 11 of the dust collecting apparatus 10, the air is induced into a vortex. The centrifugal force of the vortex separates the contaminants from the air. The fan motor portion 9 then discharges the contaminant-free air from the cleaner body 1 through a grille.

The contaminants that have been separated from the vortex of air in the cyclone body 11 are discharged into the contaminant receptacle 13 through a contaminant outlet 11*a* formed on the cyclone body 11. Accordingly, the contaminants that have been separated from the air by centrifugal force are collected in the contaminant receptacle 13.

When the contaminant receptacle 13 is full, the contaminant receptacle 13 is emptied as follows. First, a user opens a cleaner body cover 8 and removes the cyclone dust collecting apparatus 10 from a dust collecting chamber 1*a* in the cleaner body 1. Then the user carries the cyclone dust collecting apparatus 10 to a dustbin and unlatches the base plate opening/closing means 16. When the base plate opening/closing means 16 is unlatched, the base plate 15 pivots about the hinge, exposing the interior of the contaminant receptacle 13. The contaminants in the contaminant receptacle 13 are then free to fall from the contaminant receptacle 13 and into the dustbin. When the contaminant receptacle 13 has been emptied, the user returns the base plate 15 to its initial state and locks the base plate opening/closing means 16. Finally, the user mounts the cyclone dust collecting apparatus 10 back in the dust collecting chamber 1*a* of the cleaner body 1 and closes the cleaner body cover 8.

The conventional cyclone dust collecting apparatus 10, however, is relatively large, heavy, and inconvenient to use, since the user has to remove it from the dust collecting chamber 1*a* and transport it to a dustbin in order to empty the contaminant receptacle 13. Further, since the contaminants are free fall from the contaminant receptacle 13 when the base plate opening/closing means 16 is unlatched, the possibility is high that the contaminants could fall onto undesirable places, such as the floor, etc., instead of falling into the dustbin. In addition, since the user has no way to observe the contaminants in the contaminant receptacle 13, the user cannot control easily control disposal of the contaminants.

SUMMARY OF THE INVENTION

The present invention has been made to overcome the above-described problems of the related art. Accordingly, it is an object of the present invention to provide a cyclone dust collecting apparatus for a vacuum cleaner having a contaminant receptacle that is separately removable from the cyclone dust collecting apparatus by a user. This separately removable contaminant receptacle is more convenient for a user to handle, because it is both smaller and lighter than the overall dust collecting apparatus.

Another object of the present invention is to provide a cyclone dust collecting apparatus for a vacuum cleaner that enables the user to control contaminant receptacle disposal process, so as to prevent the contaminants from falling onto the floor or other undesirable places.

In order to accomplish the above objects, a cyclone dust collecting apparatus for a vacuum cleaner is interconnected with a fan motor portion of a cleaner body. The cyclone dust collecting apparatus, which separates contaminants from the air that is drawn in through a suction brush, includes a cyclone body fixed in the cleaner body and a contaminant receptacle. The cyclone body separates contaminants from the air drawn in through the suction brush. The cyclone body has a contaminant outlet, through which the contaminants are discharged. The contaminant receptacle is removably coupled to a lower side of the cyclone body. The contaminant receptacle has a contaminant inlet that corresponds to the contaminant outlet of the cyclone body, through which contaminants can pass into the contaminant receptacle.

The cyclone body includes a housing having a substantially cylindrical shape, a closed upper end, and a closed lower end. The contaminant outlet is formed in the cylindrical wall of the housing adjacent to the lower end. An air intake pipe is connected to the suction brush. The air intake pipe directs the air from the suction brush into the housing in a diagonal direction. A grille, which has a plurality of fine holes formed therein, extends from an upper end of the housing to the lower end. An air discharge pipe, one end of which is connected to the grille and the other end of which is connected to the fan motor portion, enables clean air to be discharged from the cyclone dust collecting apparatus.

The contaminant receptacle has a contaminant disposal opening formed in a top surface thereof and includes a contaminant receptacle cover that removably covers the contaminant disposal opening. The contaminant receptacle cover contacts the lower end of the cyclone body, the contaminant receptacle is coupled to the cyclone body. The contaminant receptacle further includes a handle attached to an outer surface thereof.

BRIEF DESCRIPTION OF THE DRAWINGS

The above objects and other features and advantages of the present invention will be clarified by the following detailed description when taken with the attached drawings, in which.

DETAILED DESCRIPTION OF THE PREFERRED EMBODIMENT

Figure 1:
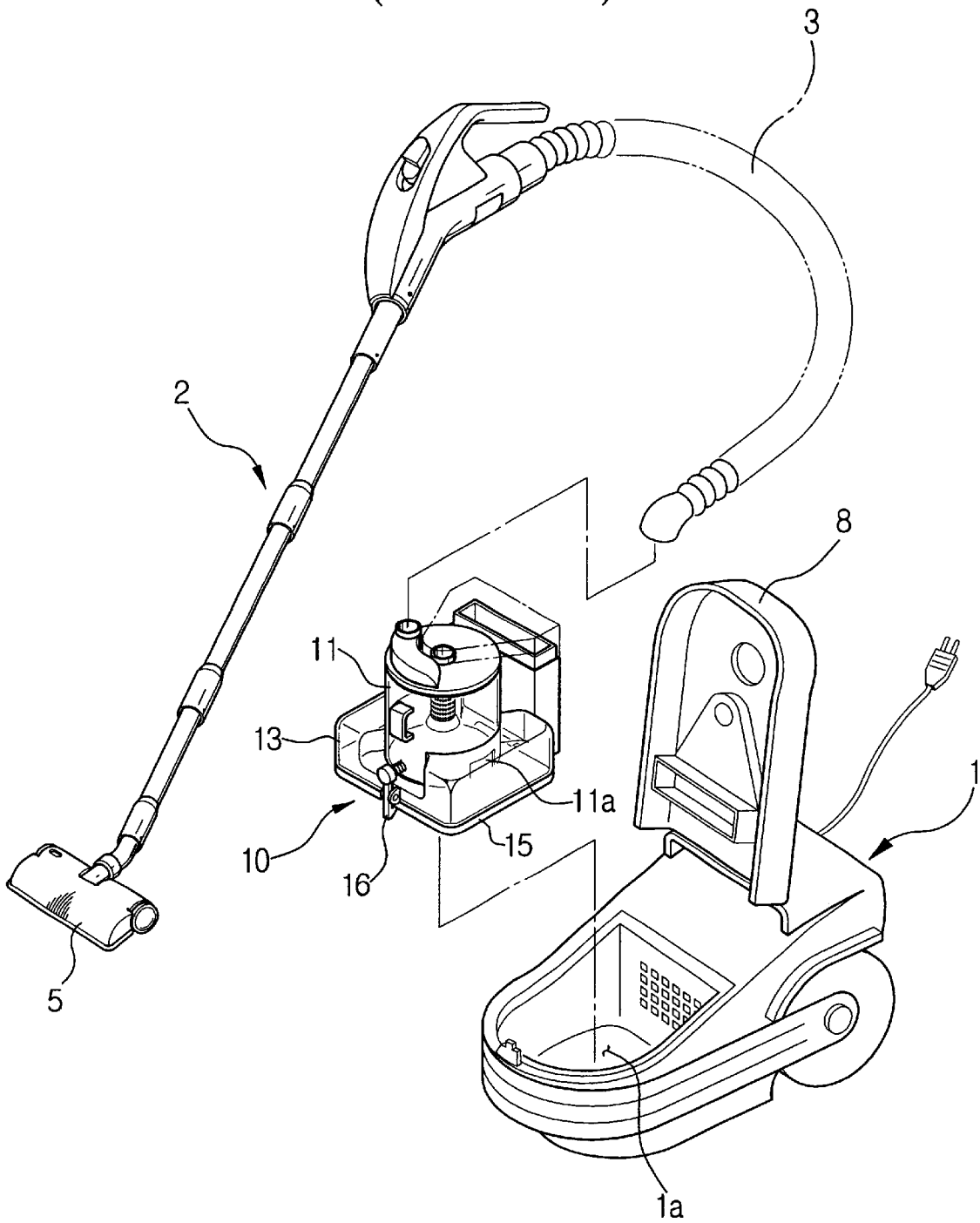
FIG. 1 (PRIOR ART)
FIG. 1 is a perspective view of a vacuum cleaner having a conventional cyclone dust collecting apparatus.

The cyclone dust collecting apparatus will be described in further detail by way of example with reference to the attached drawings. Throughout the description and drawings, the like reference numerals will be used for like elements.

Figure 2:
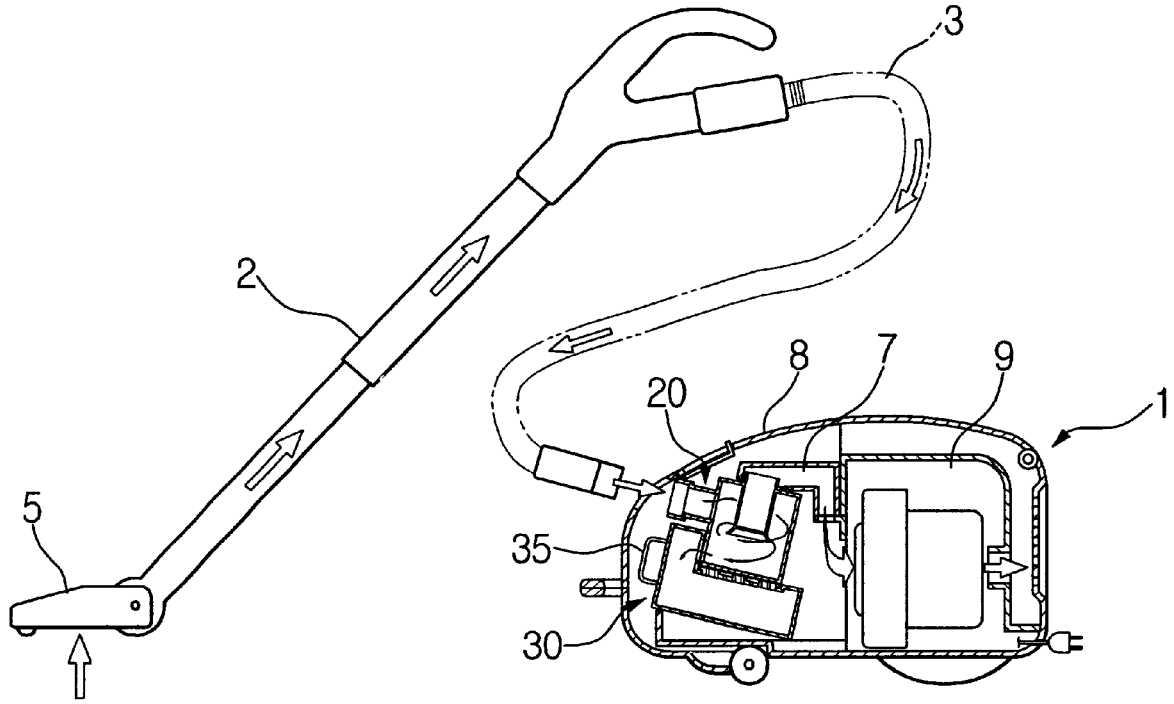
FIG. 2 is a sectional view of a vacuum cleaner having a cyclone dust collecting apparatus according to the present invention.
Figure 3:
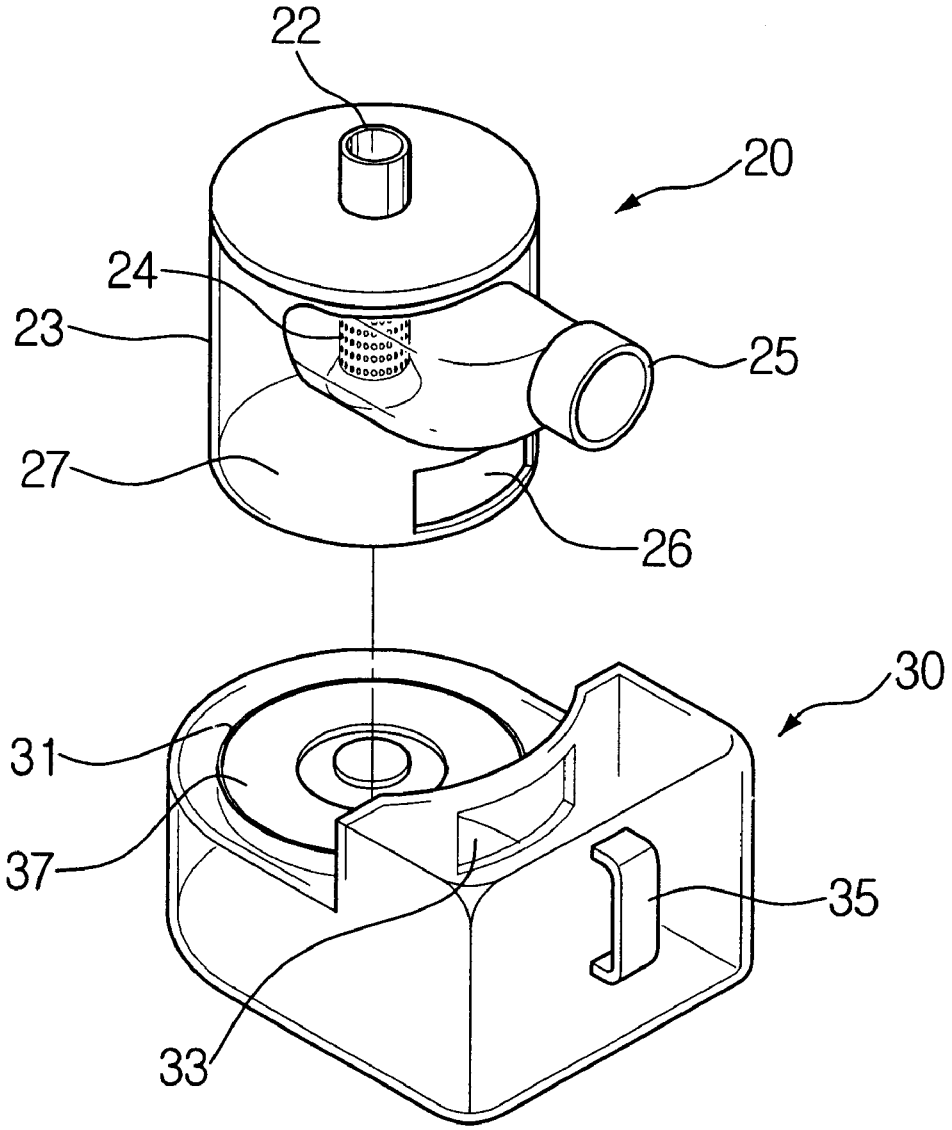
FIG. 3 is an exploded perspective view of the cyclone dust collecting apparatus shown in FIG. 2.
Figure 4:
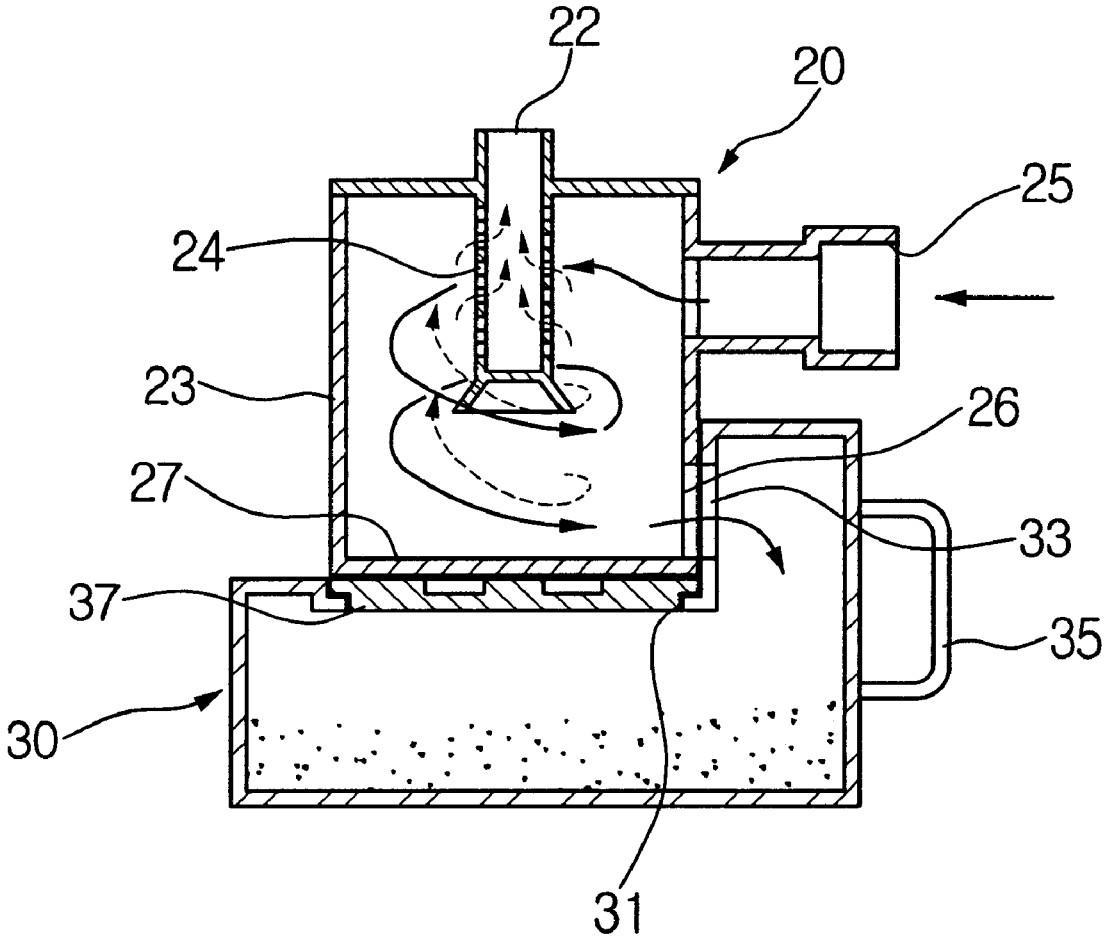
FIG. 4 is a cross-sectional view of the cyclone dust collecting apparatus of FIG. 3.

Referring to FIGS. 2 and 3, a cyclone dust collecting apparatus is fixed in the cleaner body 1. The cyclone dust collecting apparatus includes a cyclone body 20 and a contaminant receptacle 30. The cyclone body 20 separates by centrifugal force the contaminants from the air that is drawn into the cleaner body 1 through the suction brush 5. The cyclone body 20 has a contaminant outlet 26 formed therein, through which the contaminants that have been separated from the air are passed. The contaminant receptacle 30 is removably coupled to the lower side of the cyclone body 20 and has a contaminant inlet 33, which corresponds to the contaminant outlet 26. As contaminants pass from the contaminant outlet 26 of the cyclone body 20 and into the contaminant inlet 33, they are collected in the contaminant receptacle 30.

The cyclone body 20 includes a housing 23, an air intake pipe 25, a grille 24, and an air discharge pipe 22.

The housing 23 is substantially cylindrical in shape and has closed upper and lower ends. The contaminant outlet 26 is formed in the cylindrical wall of the housing 23 adjacent to a lower end 27 of the housing 23. Contaminants that have been separated by centrifugal force from the air are discharged into the contaminant receptacle 30 through the contaminant outlet 26. The size of the contaminant outlet 26 is appropriately adjusted according to the size of the housing 23.

One end of the air intake pipe 25 is connected to hose 3, which is connected to the suction brush 5, while the other end is positioned at an upper portion of the housing 23 to direct the air in a diagonal direction with respect to the housing 23.

The grille 24 extends from the upper end of the housing 23 toward the lower end 27 and has a plurality of fine holes formed in an outer surface. The grille 24 is preferably substantially cylindrical in shape.

One end of the air discharge pipe 22 is connected to the grille 24, while the other end thereof is connected to an air discharge path 7, which, in turn, is interconnected to the fan motor portion 9.

The contaminant receptacle 30 is removably coupled to the lower side of the cyclone body 20 and includes the contaminant inlet 33, which aligns with the contaminant outlet 26 of the cyclone body 20. The contaminant receptacle 30 corresponds to the lower end 27 of the housing 23 of the cyclone body 20 and covers the contaminant outlet 26 on the circumference of the housing 23. That is, the contaminant receptacle 30 is a hollow receptacle having a shape with a cross-section that substantially corresponds to letter 'L'. The contaminant inlet 33 formed on the housing 23 corresponds to the contaminant outlet 26. The contaminant receptacle 30 further includes a contaminant disposal opening 31, which is formed in an upper side of the contaminant receptacle 30. The contaminant disposal opening 31 is in contact with the lower end 27 of the housing 23, through which the contaminants may be removed from the contaminant receptacle 30. The size of the contaminant dumping opening 31 is appropriately adjusted for the most efficient contaminant disposal. It is preferable that a contaminant receptacle cover 37 is disposed on the contaminant disposal opening 31.

Meanwhile, a handle 35 is attached to a side of the contaminant receptacle 30 to enable a user to grasp the contaminant receptacle 30 with much ease.

The operation of the cyclone dust collecting apparatus for the vacuum cleaner constructed as above will be described below.

Air and contaminants are drawn through the suction brush 5, the extension pipe 2, the hose 3, and the air intake pipe 25 of the cyclone dust collecting apparatus. The air and the contaminants are drawn into the housing 23 of the cyclone body, sometime referred to herein as a cyclone chamber, 20 and induced into a vortex. The centrifugal force of the vortex separates the contaminants from the air, and the separated contaminants are discharged through the contaminant outlet 26 and into the contaminant receptacle 30 via the contaminant inlet 33 of the contaminant receptacle 30.

When the contaminant receptacle 30 is full of contaminants collected therein by the above-described process, the user empties the contaminant receptacle 30 as follows. First, the user opens a cover 8 of the vacuum cleaner body 1. The user can see the cyclone body 20 fixed in the cleaner body 1, and the contaminant receptacle 30 with the handle 35 protruding therefrom. Next, the user grabs the handle 35 and pulls the contaminant receptacle 30 in a forward direction with respect to the cleaner body 1. Accordingly, only the contaminant receptacle 30 is removed from the cleaner body 1. Then the user carries the contaminant receptacle 30 over to a dustbin. The user removes the contaminant receptacle cover 37, exposing the contaminant disposal opening 31 and turns the contaminant receptacle 30 upside-down, dumping the contaminants into the dustbin. Since the user can see the contaminants and where they are dumped, the user can control the disposal and prevent contaminants from falling onto the floor.

As described above, since the contaminant receptacle is separable from the cyclone dust collecting apparatus, it is smaller and lighter and easier for the user to handle compared to the conventional cyclone dust collecting apparatus.

Further, according to the cyclone dust collecting apparatus for vacuum cleaner of the present invention, since the contaminant receptacle cover 37 is located on top of the contaminant receptacle 30, the user has more control over disposal of the contaminants, since the user can observe the disposal of contaminants into the dustbin. The user can thus prevent contaminants from falling onto undesirable areas.

Although the preferred embodiment of the present invention has been described, it will be understood by those skilled in the art that the present invention should not be limited to the described preferred embodiment. Various changes and modifications can be made within the spirit and scope of the present invention as defined by the appended claims.

What is claimed is:

1. A cyclone dust collecting apparatus for a vacuum cleaner having a cleaner housing body and a suction brush, the suction brush drawing air and contaminants into the cleaner housing body, the cyclone dust collecting apparatus comprising:

a cyclone chamber for separating the contaminants from the air drawn through the suction brush, the cyclone chamber being fixed to the cleaner housing body and having a contaminant outlet through which the contaminants are discharged; and a contaminant receptacle removably coupled to a lower side of the cyclone chamber, the contaminant receptacle having a contaminant inlet aligned to engage with the contaminant outlet of the cyclone chamber, the contaminant outlet formed in a cylindrical wall of the chamber, the contaminant receptacle receiving contaminants that have been discharged from the cyclone chamber.

2. The cyclone dust collecting apparatus of claim 1, wherein the cyclone chamber further comprises:

a cyclone housing having a substantially cylindrical shape defining the cylindrical wall, a closed upper end and a closed lower end, the contaminant outlet formed adjacent to the lower end of the cyclone housing;

an air intake pipe for connecting to the suction brush, the air intake pipe directing the air from the suction brush in a tangential direction with respect to the cylindrical wall;

a grill extending from the upper end of the cyclone housing to the lower end, the grill having a plurality of fine holes formed in an outer surface; and an air discharge pipe, one end being connected to the grill, the other end being connected to a fan motor portion in the cleaner housing body.

3. The cyclone dust collecting apparatus of claim 1, wherein the contaminant receptacle has a contaminant disposal opening formed in a top surface thereof, the contaminant receptacle further including a contaminant receptacle cover for removably covering the contaminant disposal opening.

4. The cyclone dust collecting apparatus of claim 3, wherein the contaminant receptacle cover contacts the lower end of the cyclone chamber when the contaminant receptacle is coupled to the cyclone chamber.

5. The cyclone dust collecting apparatus of claim 1, wherein the contaminant receptacle comprises a handle attached to an outer surface thereof.

6. A vacuum cleaner comprising:

a vacuum cleaner housing body having a fan motor portion;

a suction brush coupled to the cleaner vacuum housing body, the suction brush drawing air and contaminants into the vacuum cleaner housing body; and a cyclone dust collecting apparatus disposed in the vacuum cleaner housing body, the cyclone dust collecting apparatus including:

a cyclone chamber fixed to the fan motor portion of the cleaner housing body, the cyclone chamber separating the contaminants from the air and having a contaminant outlet formed in a substantially cylindrical wall of the chamber, through which the contaminants arc discharged; and a contaminant receptacle removably coupled to a lower side of the cyclone chamber, the contaminant receptacle having a contaminant inlet aligned with the contaminant outlet of the cyclone chamber, the contaminant receptacle receiving the contaminants that have been discharged from the cyclone chamber.

7. The vacuum cleaner of claim 6, wherein the cyclone chamber further includes:

a cyclone housing defined by the substantially cylindrical, wall, a closed upper end and a closed lower end, the a contaminant outlet formed adjacent to the lower end of the cyclone housing;

an air intake pipe in communication with the suction brush, the air intake pipe directing air from the suction brush in a diagonal direction tangential to the cylindrical wall of the cyclone housing; a grill extending from the upper end of the cyclone housing to the lower end, the grill having a plurality of fine holes formed in an outer surfaces; and an air discharge pipe connecting the grill to the fan motor portion of the vacuum cleaner housing body.

8. The vacuum cleaner of claim 6, wherein the contaminant receptacle has a contaminant disposal opening formed in a top surface thereof, the contaminant receptacle further including a contaminant receptacle cover for removably covering the contaminant disposal opening.

9. The vacuum cleaner of claim 8, wherein the contaminant receptacle cover contacts the lower end of the cyclone chamber when the contaminant receptacle is coupled to the cyclone chamber.

10. The vacuum cleaner of claim 6, wherein the contaminant receptacle further includes a handle attached to an outer surface thereof.

* * * * *